US006079479A

United States Patent [19]

Osada et al.

[11] Patent Number: 6,079,479

[45] Date of Patent: Jun. 27, 2000

[54] TWIN ROLL CONTINUOUS CASTING INSTALLATION

[75] Inventors: Shiro Osada, Yokohama; Osamu Takeuchi, Mataka; Atsushi Hirata, Hiratsuka, all of Japan

[73] Assignees: Ishikawajima-Harima Heavy Industries Company Limited, Tokyo, Japan; BHP Steel (JLA) Pty Ltd., Melbourne, Australia

[21] Appl. No.: 09/100,348

[22] Filed: Jun. 19, 1998

[30] Foreign Application Priority Data

Jun. 23, 1997 [AU] Australia ..... PO7496

[51] Int. Cl.[7] ..... B22D 11/06; B22D 11/124

[52] U.S. Cl. ..... 164/428; 164/444; 164/414

[58] Field of Search ..... 164/428, 444, 164/414, 480

[56] References Cited

U.S. PATENT DOCUMENTS 4,658,882 4/1987 Oba et al. ..... 164/414
5,385,201 1/1995 Praeg ..... 164/428

FOREIGN PATENT DOCUMENTS 3-291135 12/1991 Japan ..... 164/428
5-318047 12/1993 Japan ..... 164/428

*Primary Examiner*—Harold Pyon
*Assistant Examiner*—I.-H. Lin
*Attorney, Agent, or Firm*—Miles & Stockbridge P.C.; John C. Kerins

[57] ABSTRACT

The invention addresses the problem of edge bulging and breakout of as cast strip due to a decrease of perfect solid phase shell thickness of the strip caused by heat recuperation of the unsolidified portion of the strip, by providing a chamber 19 which encloses the travel path of a strip 8 delivered from a pair of chilled rolls 1*a* and 1*b*, a pair of chilled blocks 29*a* arranged in the chamber to be positioned near a nip between the chilled rolls 1*a* and 1*b*, with each chilled block 29*a* being shaped for loose fitting over an edge of a strip 8 and being capable of injecting cooling gas toward the edge of the strip 8. When the strip 8 is to be continuously cast, the interior of the chamber 19 provides an inert gas atmosphere, in which the cooling gas injected by the cooling blocks 29*a* injection-cools the edges of the strip 8 delivered from the chilled rolls 1*a* and 1*b* at a position near the nip between the chilled rolls 1*a* and 1*b*.

7 Claims, 7 Drawing Sheets

TWIN ROLL CONTINUOUS CASTING INSTALLATION

FIELD OF THE INVENTION

The present invention relates to a twin roll continuous casting installation wherein molten metal is quenched for solidification and directly molded into a metal sheet.

PRIOR ART

It is known in the art of continuous casting that quenching of poured molten metal for solidification Into a strip will greatly improve characteristics of the material owing to formation of stable phase in the strip, drastic reduction of microsegregation and micronization of the structure and the like.

For casting such strip, there have been proposed installations in which molten metal is poured into a nip between a pair of chilled roll to be quenched into a strip.

Problems during the pouring and quenching of molten metal are deteriorated cleanliness of the molten metal due to oxygen in surrounding atmosphere as well as formation of oxided scale on the strip.

A proposal for overcoming the problems is disclosed in JP-B-3-33053.

FIG. 7 shows a twin roll continuous caster as disclosed in this Japanese patent publication. It comprises an upstream chamber 2 constituting a main-body vessel and a downstream chamber 12 disposed just below the chamber 2 and constituting a strip-delivering vessel. Prior to continuous casting of strip (strip 8), interiors of the chambers 2 and 12 are substituted into inert gas atmospheres.

Arranged in the upstream chamber 2 in the order named from above are a tundish 5, a pair of chilled rolls 1*a* and 1*b* and a pair of upper cooling gas sprays 10*a* and 10*b*. Molten metal supplied from a ladle 7 outside and above the upstream chamber 2 to the tundish 5 is poured into the nip between the chilled rolls 1*a* and 1*b* which are rotated, so that the molten metal is cooled by the rolls 1*a* and 1*b* into solidified strip 8 which is continuously delivered downward.

The strip 8 delivered by the chilled rolls 1*a* and 1*b* is cooled at its opposite surfaces by inert gas injected by the upper cooling gas sprays 10 and 10*b* and passed to the downstream chamber 12.

Arranged in the downstream chamber 12 in the order named from above are a pair of lower cooling gas sprays 15*a* and 15*b* and a pair of pinch rolls 11*a* and 11*b*. The strip 8 delivered from the upstream chamber 2 is cooled at its opposite surfaces by inert gas injected from the lower cooling gas sprays 15*a* and 15*b* and is passed outside of the downstream chamber 12.

Thus, the twin roll continuous casting installation shown in FIG. 7 suppresses deteriorated cleanliness of the molten metal and prevents oxidization of the strip surfaces in such a manner that the interiors of the upstream and downstream chambers 2 and 12 are substituted into inert gas atmospheres and the inert gas is injected to the opposite surfaces of the strip by the gas sprays in the chambers 2 and 12.

Meanwhile, a recent problem on strip in continuous casting is occurrence of bulging on the strip at its widthwise edges (edge bulging), break on the strip at the. edges (edge break) and strip fracture (breakout) due to a phenomenon that insufficient cooling on the strip at its widthwise edges may result in the unsoldifified surface of the strip just after the casting being melted again because of heat recuperation. A proposal to overcome the problem is disclosed in JP-A-5-277654.

FIGS. 8 and 9 show a twin roll continuous caster disclosed in this publication and having a pair of dog bone type chilled rolls 17*a* and 17*b* rotatably arranged below the chilled rolls 1*a* and 1*b*. The chilled rolls 17*a* and 17*b* have, at their opposite ends, enlarged roll portions which contact widthwise opposite edges on opposite surfaces of the strip 8 from the chilled rolls 1*a* and 1*b*, so that the widthwise edges of the strip 8 just after the casting is quenched to prevent edge break of the strip 8.

However, in the twin roll continuous caster as disclosed in JP-B-3-33053 (see FIG. 7), sealing of the upstream and downstream chambers 2 and 12 for maintaining the inert gas atmospheres in casting of the strip 8 will elevate temperatures in the chambers 2 and 12, so that the strip 8 must be cooled by the upper cooling gas sprays boa and lob below the chilled rolls 1*a* and 1*b*. Since the inert gas from the sprays 10*a* and 10*b* is injected over the whole surfaces of the strip 8, cooling effect may be low at the widthwise opposite edges of the strip 8, disadvantageously resulting in occurrence of edge bulging.

On the other hand, in the twin roll continuous caster as disclosed in JP-A-5-277654 (see FIGS. 8 and 9), assumption in actual operation may be made such that the chilled rolls 1*a* and 1*b* have outer diameter of 400–600 mm and the enlarged portions of the dog bone type chilled rolls 17*a* and 17*b* have outer diameter of 200 mm. Then, the distance of the dog bone type chilled rolls 17*a* and 17*b* from the chilled rolls 1*a* and 1*b* may be 300–400 mm, which may cause insufficient cooling effect on the widthwise opposite edges of the strip 8 just below the nip between the chilled rolls 1*a* and 1*b*, disadvantageously resulting in occurrence of edge bulging and breakout on the strip 8.

Further, the inventors experimentally investigated a relationship of perfect solid phase shell thickness near the edge of the strip 8 to distance of the chilled rolls 1*a* and 1*b* from the nip between the chilled rolls 1*a* and 1*b* in the manufacturing conditions that, as shown in FIG. 6, atmosphere temperature in the chamber is 1200° C., strip thickness is 2 mm and manufacturing speed is 60 m/min. As a result, it was found out that, in the condition ① in the Figure where no cooling is effected, the perfect solid phase shell thickness of the edge of the strip 8 tends to decrease to zero due to heat recuperation of unsolidified portion in the strip 8 so that edge bulging, edge break and/or breakout of the strip 8 is likely to occur on such portion The present invention was made in view of the above and has an object to provide a twin roll continuous casting installation which can alleviate decrease of the perfect solid phase shell thickness near the edge of the strip caused by heat recuperation of the unsolidified portion.

SUMMARY OF THE INVENTION

According to the invention there is provided a twin roll continuous casting installation comprising pinch rolls for clamping a strip continuously cast by a pair of chilled rolls, a chamber for enclosing travel path of the strip from the chilled rolls to the pinch rolls, said chamber having seal members airtightly in contact with outer peripheries of the chilled rolls and pinch rolls, and a pair of chilled blocks for injecting cooling medium to edges of the strip delivered from the chilled rolls, said blocks being shaped for loose fitting over the edges of the strip, one of the blocks being arranged just below one ends of the chilled rolls, the other block being arranged just below the other ends of the chilled rolls.

It is preferred that each of the chilled blocks has cooling medium passages therein to cool the chill blocks.

Preferably each of the pair of chilled blocks is adapted to be moved between a position where the chilled block is loosely fitted over the edge of the strip just below the chilled rolls and a position where the chilled block is not affected by splashing of metal dropping from the nip between the chilled rolls at the beginning of strip casting.

It is preferred that cooling gas is injected from the pair of blocks toward the edges of the strip positioned near the nip between the chilled rolls, thereby preventing decrease of perfect solid phase shell thickness of the strip due to heat recuperation of unsolidified portion to suppress edge bulging and breaking of the strip.

Preferably cooling medium is passed through cooling medium passages of the respective chilled blocks to enable radiation-cooling of the edges of the strip positioned near the nip between the chilled rolls by the blocks, thereby preventing decrease of perfect solid phase shell thickness of the strip due to heat recuperation of the unsolidified portion to more effectively suppress edge bulging and edge breaking of the strip.

It is preferred that each of the pair of chilled blocks is displaced to a position where the chilled block is not affected by splashing of molten metal dropping from the nip between the chilled rolls, thereby preventing the chilled block from being damaged.

BRIEF DESCRIPTION OF THE DRAWINGS

In order that the invention may be more fully explained one particular embodiment will be described in detail with reference to the accompanying drawings in which.

DETAILED DESCRIPTION OF THE PREFERRED EMBODIMENT

A preferred embodiment of the present invention will be described in conjunction with the attached drawings.

Figure 7:
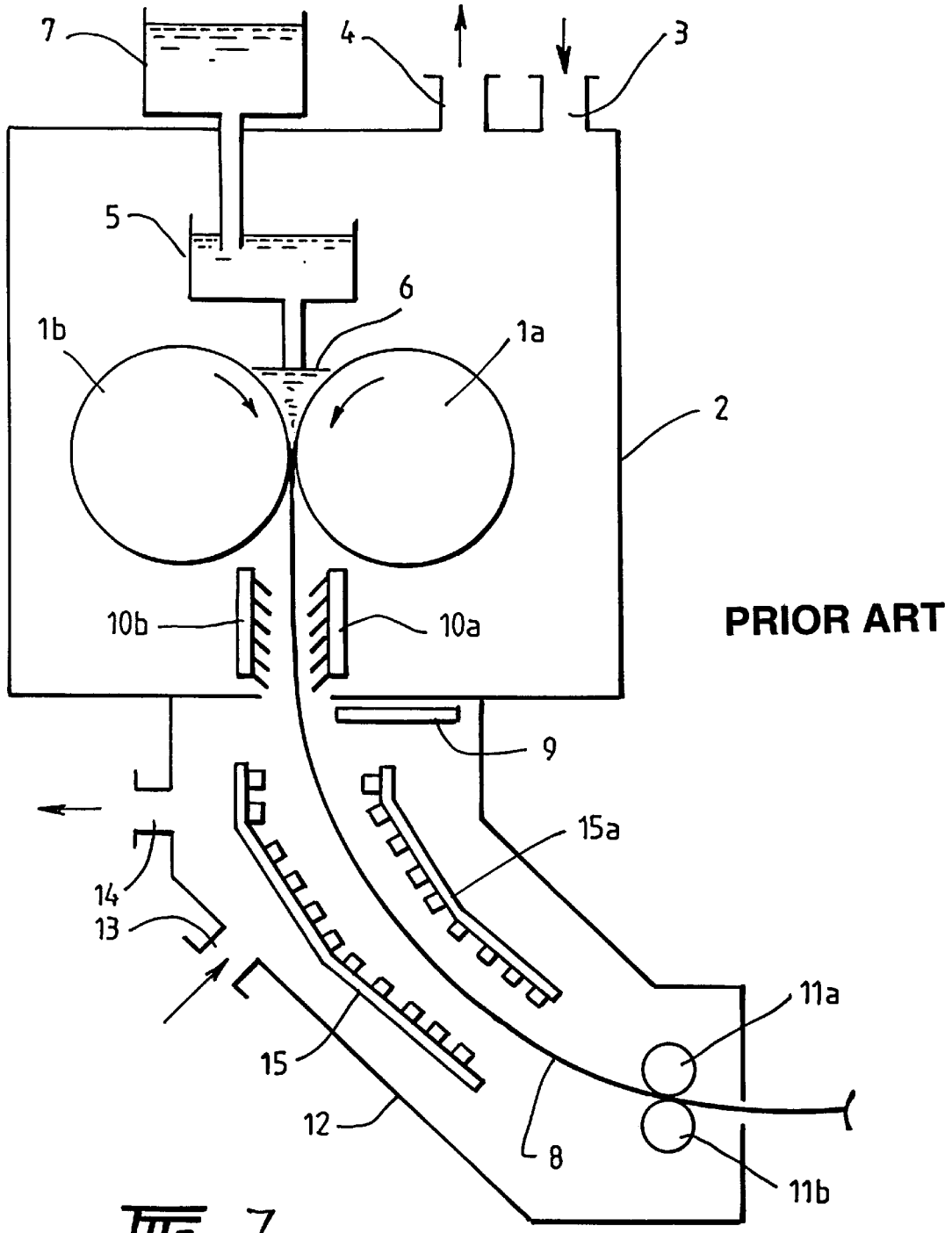
FIG. 7 is a schematic view of a twin roll continuous caster disclosed in JP-A-3-33053.
Figure 8:
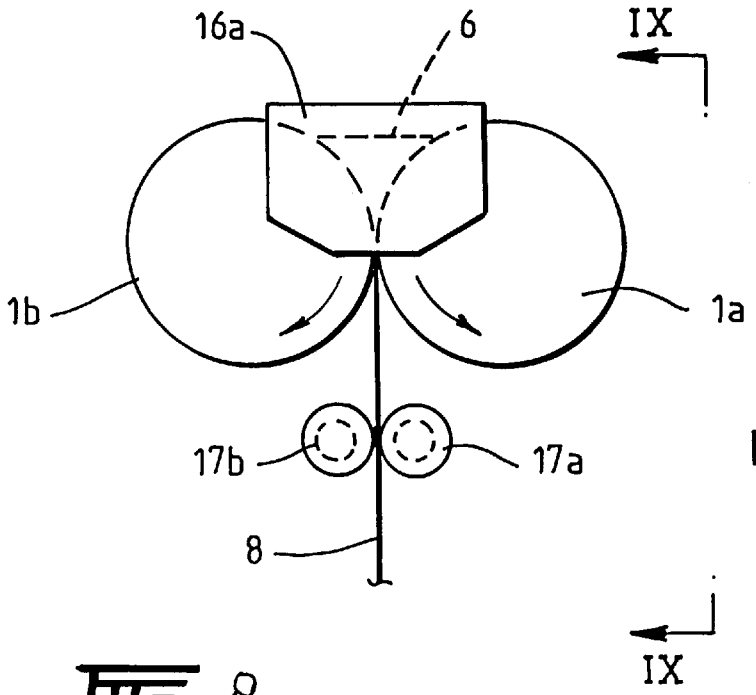
PRIOR ART FIG. 8.
FIG. 8 is a schematic view of a twin roll type thin sheet continuous caster disclosed in JP-A-5-5277654.
Figure 9:
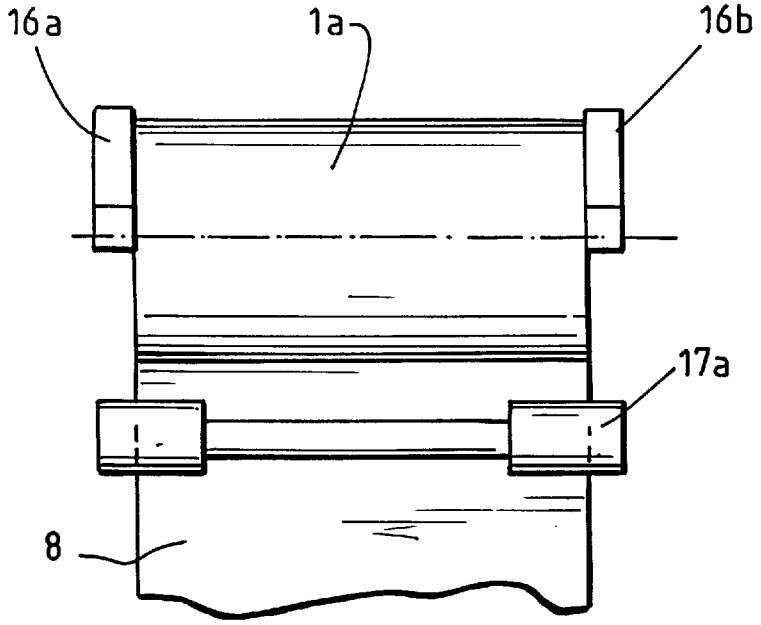
FIG. 9. PRIOR ART
FIG. 9 is view looking in the direction of arrows IX—IX in FIG. 8.

FIGS. 1 to 5 show an embodiment of a twin roll continuous casting installation of the invention where the same components as in FIGS. 7 to 9 are referred to by the same reference numerals.

Reference numerals 16 and 16*b* represents a pair of side weirs. One side weir 16*a* is positioned to have surface contact with one end surfaces of chilled rolls 1*a* and 1*b*. The other side weir 16*b* is positioned to have surface contact with the other end surfaces of the chilled rolls 1*a* and 1*b*. A molten metal pool 6 is formed in a space defined by the chilled rolls 1*a* and 1*b* and the side weirs 16*a* and 16*b*.

Reference numerals 18*a* and 18*b* represent a pair of pinch rolls which are positioned horizontally on one side below the chilled roll 1*a* so that a strip 8 from the chilled rolls 1*a* and 1*b* may be clamped from above and below.

Reference numeral 19 represents a chamber which is formed to enclose travel path of the strip 8 from the chilled rolls 1*a* and 1*b* to the pinch rolls 18*a* and 18*b*.

This chamber 19 is formed, at its portions just below the side weirs 16*a* and 16*b*, with pockets 19*a* and 19*b* for standby of below-mentioned chilled blocks 29*a* and 29*b*, respectively.

Arranged in positions on the chamber 19 are an inert gas supply port 20 for supplying inert gas as non-oxidizing gas to the chamber 19 as well as a discharge port 21.

Reference numerals 22*a* and 22*b* represent seal members which are mounted at an end of the chamber 19 facing the chilled rolls 1*a* and 1*b* so that the seal members 22*a* and 22*b* airtightly contact outer peripheries of the chilled rolls 1*a* and 1*b*.

Reference numerals 23*a* and 23*b* represent seal members which are mounted at an end of the chamber 19 facing the pinch rolls 18*a* and 18*b* so that the seal members 23*a* and 23*b* airtightly contact outer peripheries of the pinch rolls 18*a* and 18*b*.

As these seal members 22*a*, 22*b*, 23*a* and 23*b*, labyrinth seal or wire seal comprising a number of metal strands may be used.

Reference numerals 24*a* and 24*b* represent a pair of cylinders for withdrawal. The cylinders 24*a*, 24*b* comprises a cylinder body 25*a*, 25*b* which Is mounted on an outer side of the pocket 19*a*, 19*b* of the chamber 19 via a bracket 26*a*, 26*b* such that It Is positioned in parallel with rotary axes xa and xb of the chilled rolls 1*a* and 1*b*.

The cylinder 24*a*, 24*b* has a piston rod 27*a*, 27*b* which extends via a seal member 28*a*, 28*b* through-the pocket 19*a*, 19*b* of the chamber 19. The piston rod 27*a*, 27*b* has a tip which is adapted to be moved toward or away from the edge 8*a*, 8*b* of the strip 8 position ed near the nip between the chilled rolls 1*a* and 1*b* when fluid pressure is applied to a head- or rod-side fluid chamber of the cylinder body 25*a*, 25*b*.

The cylinders 24*a* and 24*b* may be designed such that fluid pressure is simultaneously applied to their head- or rod-side fluid chambers; alternatively, the cylinders 24*a* and 24*b* may be designed to be applied with fluid pressure independently from each other.

Figure 4:
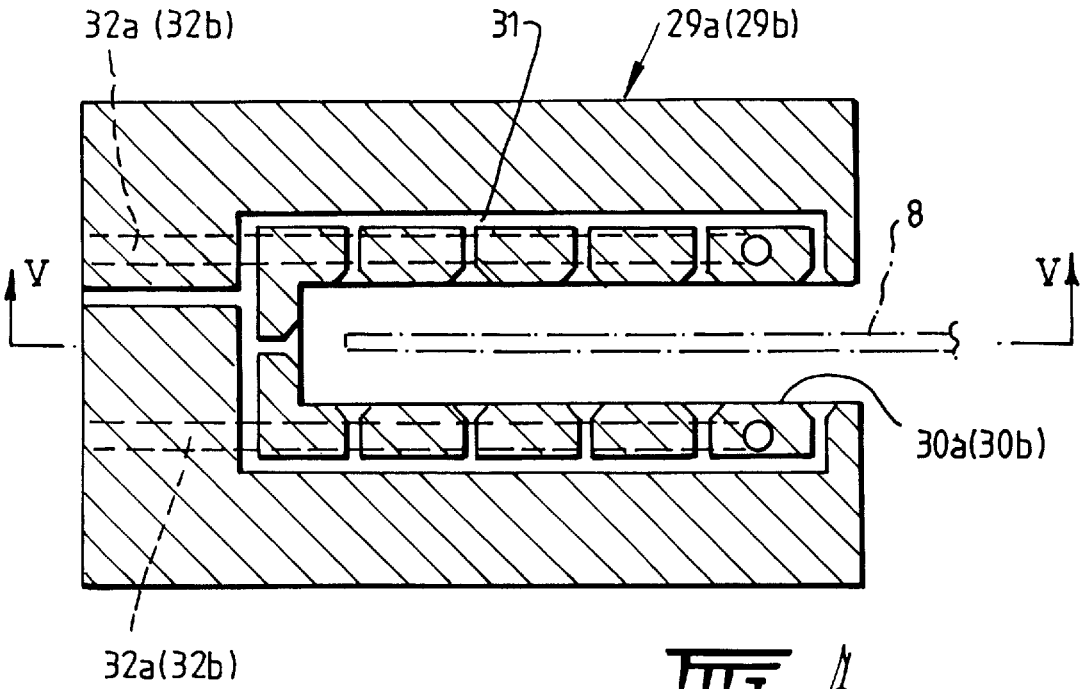
FIG. 4 is a detailed, cross sectional view of the chilled block shown in FIGS. 1 to 3.
Figure 5:
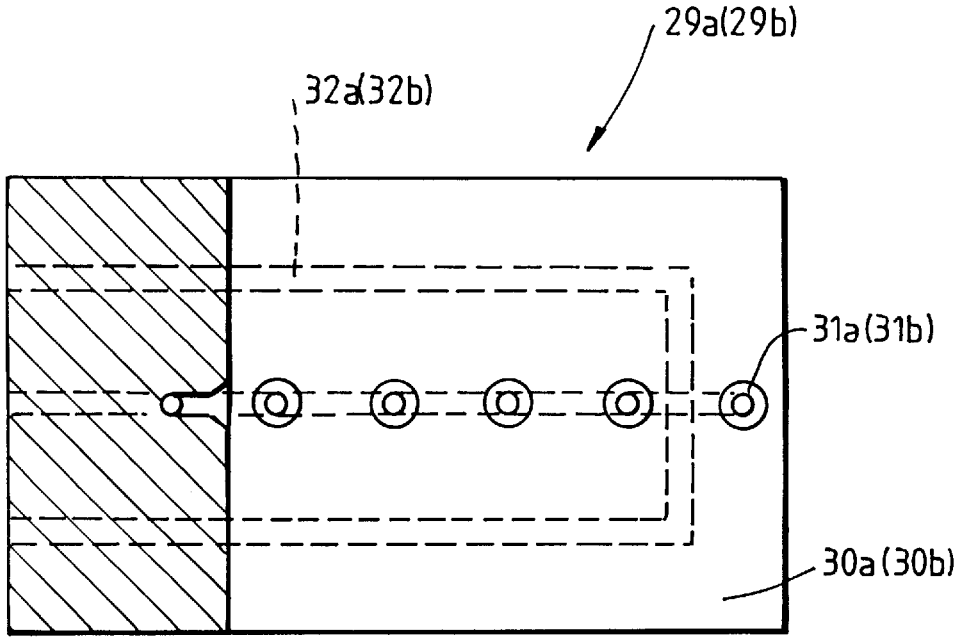
FIG. 5 is a view looking in the direction of the arrows V—V in FIG. 4.

Reference numerals 29*a* and 29*b* denote a pair of chilled blocks each of which has a notch 30*a*, 30*b* extending from a distal end toward a proximal end of the block so that it may be loosely fitted over the edge 8*a*, 8*b* of the strip 8 (see FIG. 4).

With the chilled block 29*a*, 29*b* being loosely fitted over the edge 8*a*, 8*b* of the strip 8 a cooling gas passage 31*a*, 31*b* extends through the-chilled block 29*a*, 29*b* from a proximal end surface thereof to the notch 30*a*, 30*b*; and cooling medium passages 32*a*, 32*b* extend through the block 29*a*, 29*b* from the proximal end surface thereof via vicinity of the distal end thereof back to the proximal end thereof.

The chilled block 29*a*, 29*b* is arranged in the pocket 19*a*, 19*b* of the chamber 19.

The piston rod 27*a*, 27*b* of the withdrawal cylinder 24*a*, 24*b* is fixed at its tip to the proximal end face of the chilled block 29*a*, 29*b*. Displacement of said piston rod 27*a*, 27*b* will cause the chilled block 29*a*, 29*b* to be moved between a position where the chilled block is loosely fitted over the edge 8*a*, 8*b* of the strip 8 delivered from the chilled rolls 1*a* and 1*b* and a position where the chilled block is not affected by splashing of molten metal dropping from the nip between the chilled rolls 1*a* and 1*b* at beginning of casting of the strip 8.

Arranged near the chilled block 29*a*, 29*b* is a monitor camera (not shown) for ascertaining whether splashing of molten metal at the beginning of the strip casting has cease or not so that an operator may confirm internal condition of the chamber 19.

The above-mentioned chilled blocks 29*a* and 29*b* may be produced by sequentially performing machining operations such as cutting, drilling and partial hole-filling of metal material; alternatively, they may be produced by precision integrated casting using lost wax technique.

A nitrogen gas (inert gas) storage vessel (not shown) which serves as cooling-gas supply source is connected to an proximal end (an end on the proximal end surface of the chilled block 29*a*, 29*b*) of the cooling gas passage 31*a*, 31*b*, nitrogen gas being injected through the chilled block 29*a*, 29*b*.

A cooling water vessel (not shown) which serves as cooling medium supply source is connected through a cooling medium supply pipe (not shown), which airtightly passes through the chamber 19 and is flexible, and through a water supply pump (not shown) to one end of the cooling medium passage 32*a*, 32*b*. The other end of the passage 32*a*, 32*b* is connected Through a cooling medium recovery pipe (not shown), which airtightly passes through the chamber 19 and is flexible, and through a heat exchanger (not shown) to the above-mentioned cooling water vessel. Thus, cooling water will continuously flow through the cooling medium passage 32*a*, 32*b*.

Flowing of the cooling water through the cooling medium passage 32*a*, 32*b* is not limited to the above-mentioned circulating technique. Alternatively, the cooling water may merely pass through the passage without circulating.

Reference numeral 33 represents a sledding table in the form of curved plate when viewed axially of the chilled rolls 1*a* and 1*b*.

The sledding table 33 is arranged in the chamber 19 below the chilled rolls 1*a* and 1*b* and the chilled blocks 29*a* and 29*b* so that the table 33 may be swung between a guide position (the condition shown by two-dot chain line in FIG. 1) where the table 33 guides substantially horizontally the strip 8 from the chilled rolls 1*a* and 1*b* toward the above-mentioned pinch rolls 18*a* and 18*b* and a standby position (the condition shown by solid line in FIG. 1) hanging downward from the guide position.

Next, mode of operation of the twin roll continuous casting installation shown in FIGS. 1 to 5 will be described.

When the strip 8 is to be continuously cast by the chilled rolls 1*a* and 1*b*, prior to the casting of the strip 8, nitrogen gas is charged into the chamber 19 through the supply port 20 and discharge through the discharge port 21 is made to some extent to maintain the interior pressure, thereby turning the interior of the chamber 19 to a non-oxidizing gas atmosphere (inert gas atmosphere).

Each of the chilled blocks 29*a* and 29*b* is withdrawn by the cylinder 24*a*, 24*b* to a standby position where the chilled block is not affected by splashing of the molten metal dropping from the nip between the chilled rolls 1*a* and 1*b* at the beginning of casting of the strip 8, and the cooling water is preliminarily passed continuously through the cooling medium passage 32*a*, 32*b* of the chilled block 29*a*, 29*b*; and the sledding table 33 is swung to the above-mentioned guide position.

Figure 1:
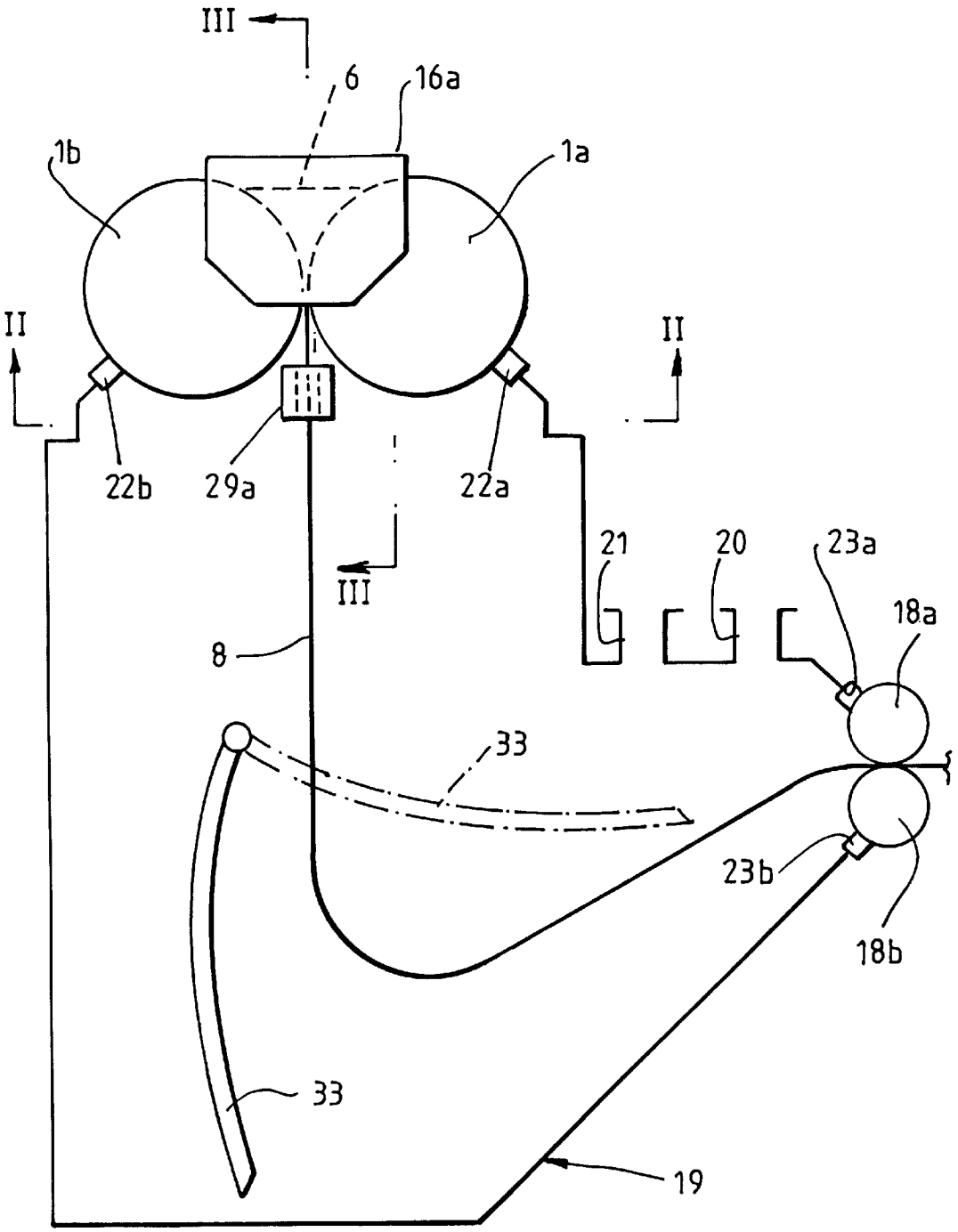
FIG. 1 is a schematic view, looking from one end side of the chilled rolls, of an embodiment of a twin roll continuous casting installation according to the invention.
Figure 2:
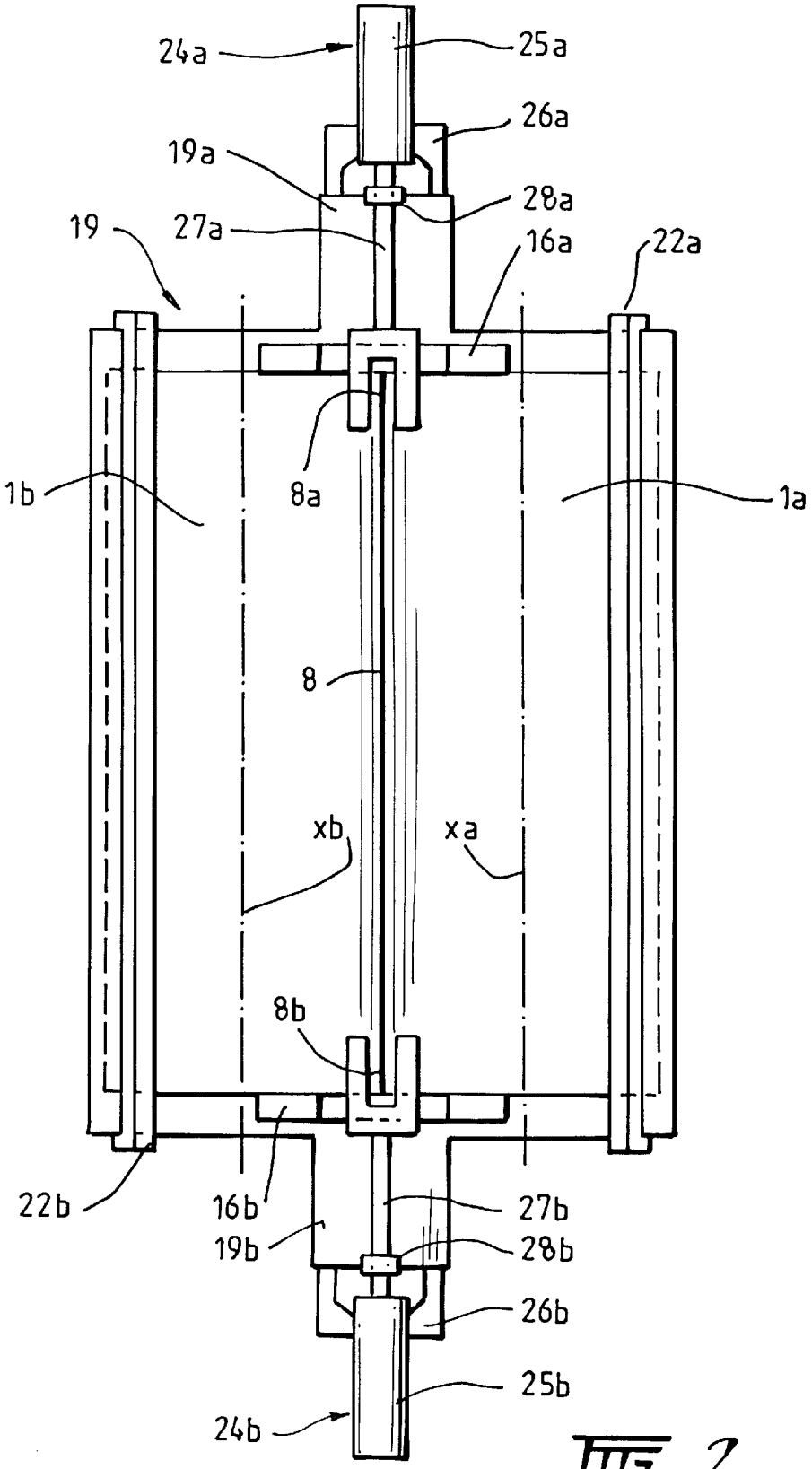
FIG. 2 is a view looking in the direction of the arrows II—II in FIG. 1.
Figure 3:
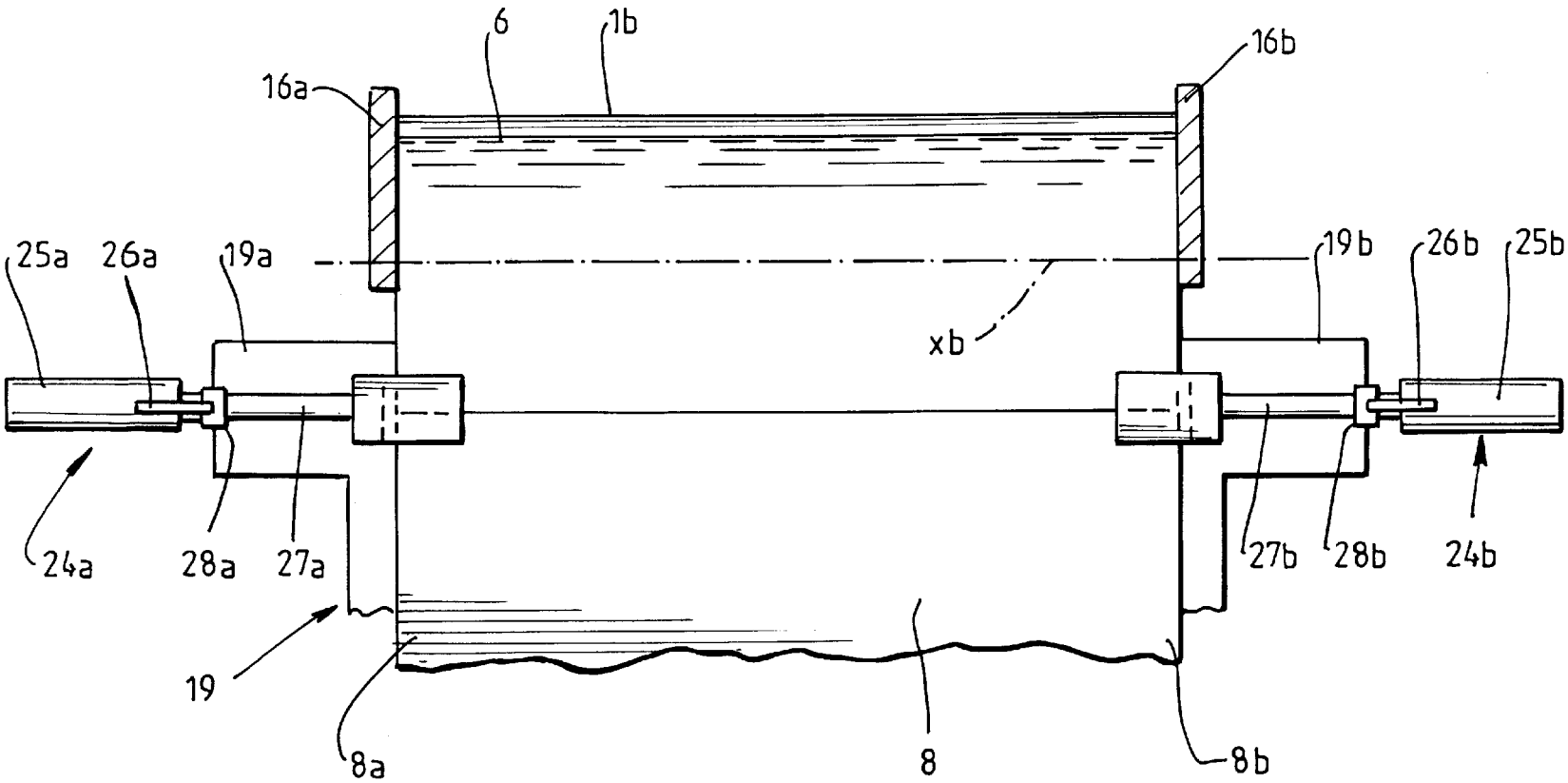
FIG. 3 is a view looking in the direction of the arrows III—III in FIG. 1.

Upon completion of the preparations as described above, the molten metal is supplied to a space defined by the chilled rolls 1*a* and 1*b* and the side weirs 16*a* and 16*b* to form the molten metal pool 6. Then, the chilled rolls 1*a* and 1*b* positioned at right and left in FIG. 1 are rotated clockwise and counterclockwise, respectively, at the same time.

When splashing of the molten metal dropping from the nip between the chilled rolls 1*a* and 1*b* has ceased at the beginning of the casting, the metal solidified at the nip between the chilled rolls 1*a* and 1*b* is molded into a strip 8 with a thickness corresponding to the roll gap of the chilled rolls 1*a* and 1*b* and is continuously delivered downwardly of the chilled rolls 1*a* and 1*b*.

On the other hand, just when the splashing of the molten metal has ceased, the chilled blocks 29*a* and 29*b* are moved by the cylinders 24*a* and 24*b* to be loosely fitted over the edges 8*a* and 8*b* of the strip 8. At the same time, the nitrogen gas is injected as cooling gas through the chilled blocks 29*a* and 29*b*. Injection cooling by the nitrogen gas and radiation cooling by the cooling water passing through the chilled blocks 29*a* and 29*b* will cool the edges 8*a* and 8*b* of the strip 8 positioned near the chilled rolls 1*a* and 1*b*.

The strip 8 which has been injection- and radiation-cooled by the chilled blocks 29*a* and 29*b* in the chamber 19 with non-oxidizing atmosphere, is guided substantially horizontally by the sledding table 33 to the pinch rolls 18*a* and 18*b* and is sent out of the chamber 19 through the pinch rolls 18*a* and 18*b*.

When the strip 8 is started to be sent out of the chamber 19, the sledding table 33 is swung to the above-mentioned standby position.

Using the twin roll continuous casting installation shown in FIG. 1, investigation was made on a relationship of perfect solid phase shell thickness near the edge of the strip 8 of distance from the nip between the chilled rolls 1*a* and 1*b* in the following respective cases under the manufacturing conditions that strip thickness is 2 mm, manufacturing speed is 60 m/min and atmosphere temperature is 1200° C.:

① No cooling is performed on the strip 8.

② The strip 8 is injection-cooled by nitrogen gas injected through the cooling gas passages 31*a* and 31*b* of the chilled blocks 29*a* and 29*b* at a flow rate of 150 m/sec and is radiation-cooled by the cooling water continuously passed through the cooling medium passages 32*a* and 32*b*.

③ The strip 8 is injection-cooled by nitrogen gas injected through the cooling gas passages 31*a* and 31*b* of the chilled blocks 29*a* and 29*b* at a flow rate of 300 m/sec and is radiation-cooled by the cooling water continuously passed through the cooling medium passages 32*a* and 32*b*.

Figure 6:
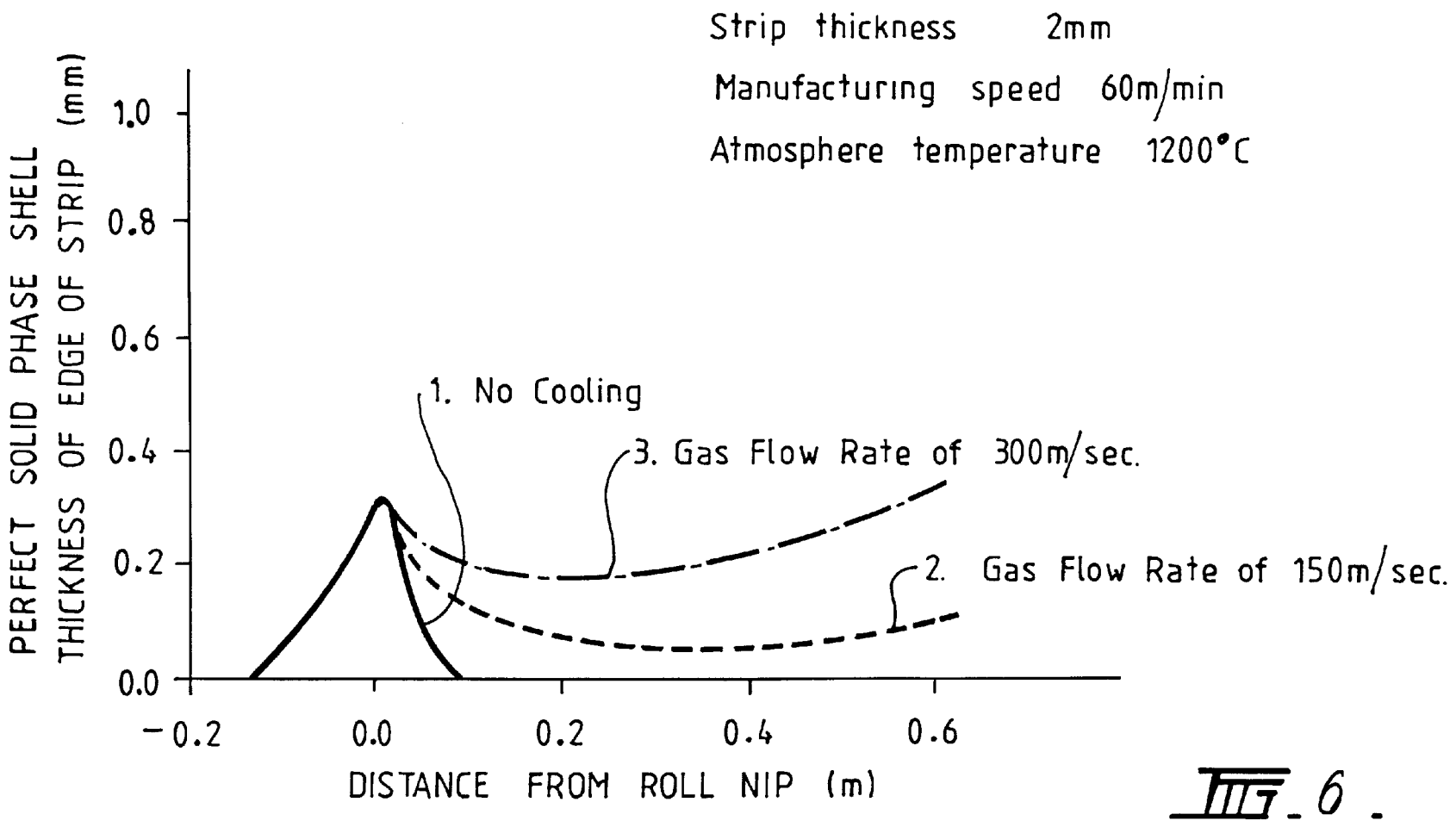
FIG. 6 is a graph showing a relationship of perfect solid phase shell thickness at the edge of a strip to distance from nip between chilled rolls in the twin roll continuous casting installation shown in FIG. 1.

As a result, as shown in FIG. 6, compared with the case ① where no cooling is performed, decrease of perfect solid phase shell thickness of the edge of the strip 8 due to heat recuperation of the unsolidified portion in the strip 8 tends to be suppressed in the cases ② and ③ where injection and radiation coolings were carried out near the nip between the chilled rolls 1*a* and 1*b*.

In a range investigated, the more the flow rate of the nitrogen gas is, the more the strip 8 is accelerated in solidification.

As described above, in the twin roll continuous casting installation shown in FIGS. 1 to 5, in the chamber 19 with non-oxidizing atmosphere, the edges 8*a* and 8*b* of the strip positioned near the chilled rolls 1*a* and 1*b* are injection-cooled by the nitrogen gas injected through the cooling gas passages 31*a* and 31*b* of the chilled blocks 29*a* and 29*b* and are radiation-cooled by the cooling water passed through the cooling medium passages 32*a* and 32*b* of the chilled blocks 29*a* and 29*b*. Therefore, any decrease of perfect solid phase shell thickness of the strip 8 at its edges 8*a* and 8*b* caused by heat recuperation of unsolidified portion can be prevented, and edge bulging and breakout of the strip 8 can be suppressed.

In the twin roll continuous casting installation shown in FIGS. 1 to 5, the chilled blocks 29*a* and 29*b* may be moved to the positions where the chilled blocks are not affected by splashing of the molten metal dropping from the nip between the chilled rolls 1*a* and 1*b*. As a result, the chilled blocks 29*a* and 29*b* can be prevented from being damaged.

It is of course to be understood that the twin roll continuous casting installation of the present invention is not limited to the above embodiment and that various changes and modifications may be made without departing from the spirit and the scope of the invention. For example, in lieu of the nitrogen gas, argon or helium gas may be used as inert gas for attainment of non-oxidizing atmosphere in the chamber as well as for injection cooling of the strip.

EFFECT OF THE INVENTION

As described above, according to a twin roll continuous casting installation of the invention, the following superb effects can be obtained:

(1) In accordance with the invention cooling gas is injected toward the edges of the strip positioned near the roll nip of the chilled rolls from the chilled blocks positioned just below the respective chilled rolls. Thus, decrease of perfect solid phase shell thickness of the strip due to heat recuperation of the unsolidified portion can be alleviated and edge bulging and breakout of the strip can be suppressed.

(2) In twin roll continuous casting installations according to a preferred embodiment of the invention in addition to injection of the cooling gas from the chilled blocks to the strip, the cooling medium is passed through the cooling medium passages of the respective chilled blocks to radiation-cool the edges of the strip positioned near the nip between the chilled rolls so that any decrease of perfect solid phase shell thickness of the strip caused by heat recuperation of the unsolidified portion can be alleviated. Accordingly, edge bulging and breakout of the strip can be further effectively suppressed.

(3) In twin roll continuous casting installations according to other preferred embodiments of the invention, each of the paired chilled blocks may be moved to a position where the chilled block is not affected by splashing of the molten metal dropping from the nip between the chilled rolls. Thus, damage of the chilled blocks due to splashing of the molten metal at the beginning of the strip casting can be prevented.

What is claimed is:

1. A twin roll continuous casting installation comprising pinch rolls for clamping a strip continuously cast by a pair of chilled rolls, a chamber for enclosing a travel path of the strip from the chilled rolls to the pinch rolls, said chamber having seal members airtightly in contact with outer peripheries of the chilled rolls and pinch rolls, and a pair of chilled blocks for injecting a cooling medium to the edges of the strip delivered from the chilled rolls, said blocks being shaped for loose fitting over the edges of the strip, a first block of said pair of blocks being positioned just below a first end of the chilled rolls, a second block of said pair of blocks being positioned just below a second end of the chilled rolls, wherein each of the chilled blocks has cooling medium passages therein to cool the chilled blocks.

2. A twin roll continuous casting installation as defined in claim 1 wherein each of the pair of chilled blocks is movable between a position at which the chilled block is loosely fitted over the edge of the strip just below the chilled rolls, and a position at which the chilled block is not affected by splashing of metal dropping from the nip between the chilled rolls at the beginning of strip casting.

3. A twin roll continuous casting installation according to claim 2 wherein cooling gas is injected from the first and second blocks of the pair of blocks toward the edges of the strip positioned near the nip between the chilled rolls, thereby preventing a decrease of perfect solid phase shell thickness of the strip due to heat recuperation of an unsolidified portion of the strip and thereby suppressing edge bulging and breaking of the strip.

4. A twin roll continuous casting installation according to claim 2 wherein said cooling medium is passed through cooling medium passages of the respective first and second chilled blocks to enable radiation-cooling of the edges of the strip positioned near the nip between the chilled rolls by the blocks, thereby preventing a decrease of perfect solid phase shell thickness of the strip due to heat recuperation of the unsolidified portion and thereby more effectively suppressing edge bulging and edge breaking of the strip.

5. A twin roll continuous casting installation according to claim 1 wherein cooling gas is injected from the first and second blocks of the pair of blocks toward the edges of the strip positioned near the nip between the chilled rolls, thereby preventing a decrease of perfect solid phase shell thickness of the strip due to heat recuperation of an unsolidified portion of the strip and thereby suppressing edge bulging and breaking of the strip.

6. A twin roll continuous casting installation according to claim 5 wherein said cooling medium is passed through cooling medium passages of the respective first and second chilled blocks to enable radiation-cooling of the edges of the strip positioned near the nip between the chilled rolls by the blocks, thereby preventing a decrease of perfect solid phase shell thickness of the strip due to heat recuperation of the unsolidified portion and thereby more effectively suppressing edge bulging and edge break of the strip.

7. A twin roll continuous casting installation according to claim 1 wherein said cooling medium is passed through cooling medium passages of the respective first and second chilled blocks to enable radiation-cooling of the edges of the strip positioned near the nip between the chilled rolls by the blocks, thereby preventing a decrease of perfect solid phase shell thickness of the strip due to heat recuperation of the unsolidified portion and thereby more effectively suppressing edge bulging and edge breaking of the strip.

* * * * *